US006250966B1

(12) United States Patent
Hashimoto et al.

(10) Patent No.: US 6,250,966 B1
(45) Date of Patent: Jun. 26, 2001

(54) ELECTRICAL CONNECTOR

(75) Inventors: Shinichi Hashimoto, Tokyo; Tadahiro Fumikura, Chiba, both of (JP)

(73) Assignee: Tyco Electronics Corporation, Wilmington, DE (US)

( * ) Notice: Subject to any disclaimer, the term of this patent is extended or adjusted under 35 U.S.C. 154(b) by 0 days.

(21) Appl. No.: 09/534,894

(22) Filed: Mar. 24, 2000

(30) Foreign Application Priority Data

Mar. 24, 1999 (JP) ..... 11-079680

(51) Int. Cl.[7] ..... H01R 23/70
(52) U.S. Cl. ..... 439/631; 439/495; 439/885
(58) Field of Search ..... 439/495, 631, 439/733.1

(56) References Cited

U.S. PATENT DOCUMENTS 3,366,919 * 1/1968 Gammel, Sr. et al. .
3,923,364 * 12/1975 Shapiro et al. ..... 439/176
5,277,621 * 1/1994 Seto ..... 439/493
5,904,586 * 5/1999 Takayasu ..... 439/260
5,928,027 * 7/1999 Kunishi ..... 439/495

OTHER PUBLICATIONS

Japanese Abstract JP09199241, Relay Connector For Flexible Base Plate, Application No. 08024840, Filed 19960119, Published 19970731.

* cited by examiner

*Primary Examiner*—Tulsidas Patel
*Assistant Examiner*—Thanh-Tam Le

(57) ABSTRACT

An electrical connector 10 consists of an insulating housing 20 having cavities 21 into which contacts 50 are inserted and secured by press fit engagement. Contacts 50 are fabricated from a metal sheet material by punch cutting and comprise two pairs of female-type contacting sections 60, 70 with a base section 80 located between them that is pressed in the inner side walls of the cavities 21.

14 Claims, 4 Drawing Sheets

ELECTRICAL CONNECTOR

FIELD OF THE INVENTION

The invention relates to electrical connectors that are intended for the coupling of paired devices arranged in mutually opposed directions.

BACKGROUND OF THE INVENTION

An example of a connector for coupling devices arranged in mutually opposed directions can be found in Patent Disclosure Hei 9 (1997)-199241. The disclosed electrical connector is designed to join two flexible circuit boards arranged at opposite sides of the connector and to form an electrical connection between the flexible circuit boards. In order to accept the flexible circuit boards, the contacts embedded in the insulating housing of the electrical connector have female type contacting sections. The contacts have press-in lugs for the purposes of being embedded in the insulating housing. The press-in lugs that extend virtually parallel to the female-type contacting sections fit into special cavities provided in the insulating housing, thus securing the contacts in the insulating housing.

Due to the fact that in the electrical connector described in the above mentioned patent disclosure, the press-in lugs are arranged virtually parallel to the female-type contacting sections, the contact receiving cavities provided in the insulating housing are relatively large, resulting in relatively large overall dimensions of the electrical connector.

SUMMARY OF THE INVENTION

An object of the present invention is to offer an electrical connector for electrical coupling between devices that are arranged in mutually opposed directions and that is characterized by easy assembly operations and small overall dimensions.

Accordingly, the present invention provides an electrical connector having contacts that are fabricated from a metal sheet by punch cutting and have primary and secondary female type contacting sections extending in one plane in opposite directions, with said contacts being secured in the cavities provided in an insulating housing by pressing, and by the fact that the above mentioned contacts have a base section located at the midpoint between said primary and secondary female contacting sections that is pressed in the above mentioned cavities.

An electrical connector is further provided having primary and secondary female type contacts which each have two mutually opposed arms. One arm from the pair of arms of said primary female type contacting section has a relatively lower resilience.

An electrical connector is further provided having primary and secondary female type contacts wherein the primary female type contacting section joins the base section only at the side of one arm. A pair of spring-loaded arms of the secondary female type contacting section is of a symmetrical configuration extending in the longitudinal direction. Each of the spring-loaded arms of the secondary female type contacting section extend toward its free end approximately in a straight line.

An electrical connector is further provided wherein the carrier strip holding the primary and secondary female type contacts is joined to the contacts at the front ends of spring-loaded arms of the secondary female type contacting section, and this connection is cut off after said contacts are secured in the insulating housing.

An electrical connector is further provided having primary and secondary female type contacts mounted in cavities in an insulating housing, the housing having a receiving slot which intersects the cavities. The insulating housing has a through opening extending in the vertical direction at the location of front ends of arms of the secondary female type contacting section. Edges of said through openings have slanted surfaces.

BRIEF DESCRIPTION OF THE DRAWINGS

Embodiments of the present invention will now be described by way of example with reference to the accompanying drawings, in which.

DETAILED DESCRIPTION OF THE INVENTION

Figure 1:
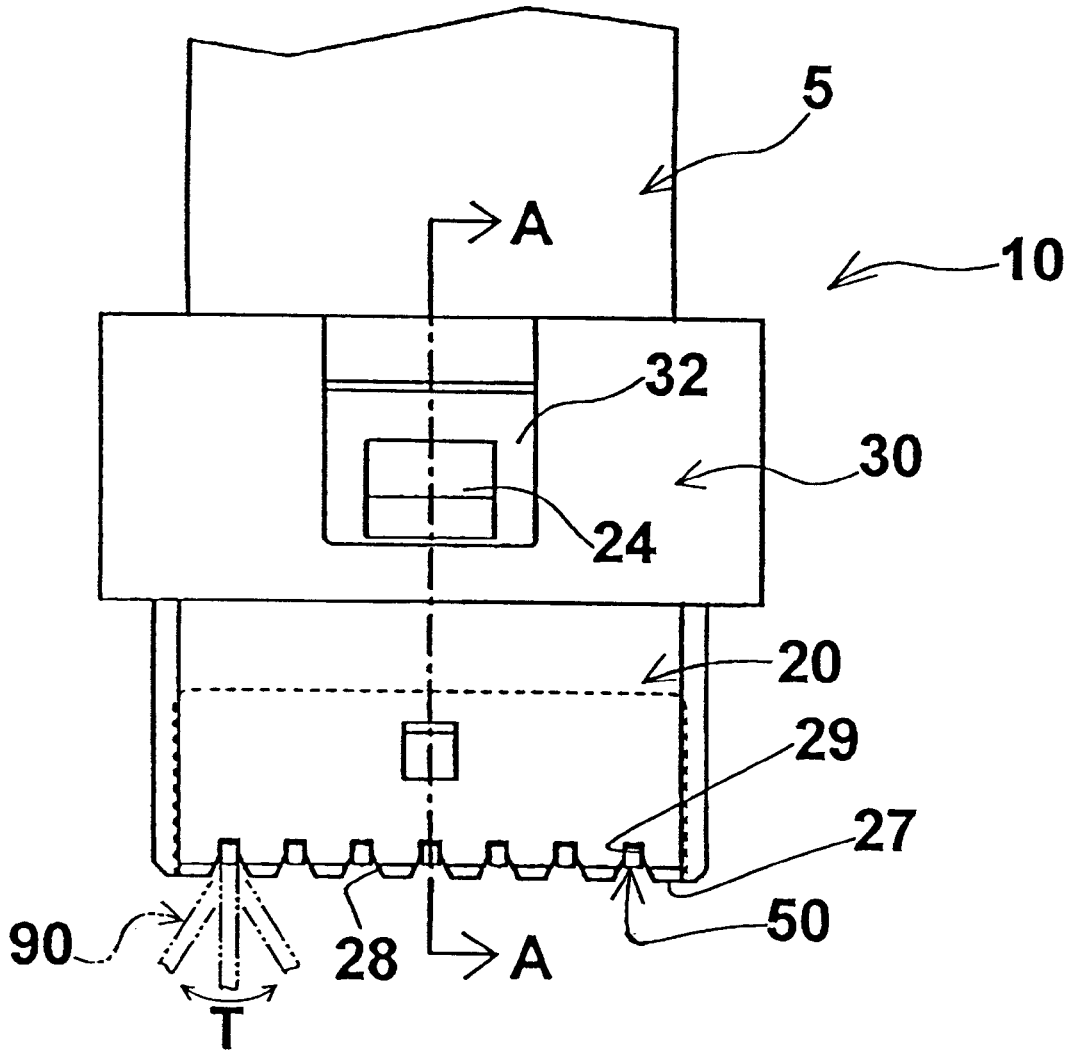
FIG. 1 is a plan view of the electrical connector of the present invention with a flexible circuit board connected to it at one side.
Figure 2:
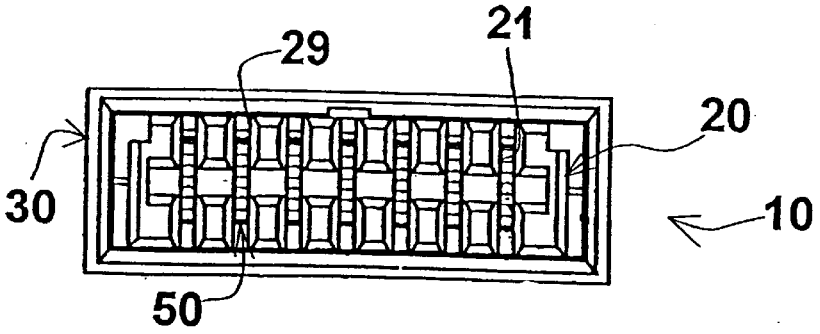
FIG. 2 is front view of the electrical connector of FIG. 1.
Figure 3:
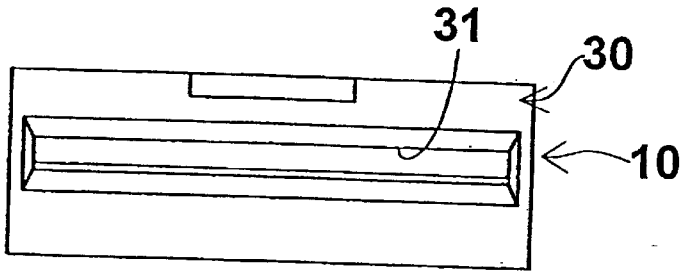
FIG. 3 is a back view of the electrical connector of FIG. 1 with the flexible circuit board omitted.
Figure 4:
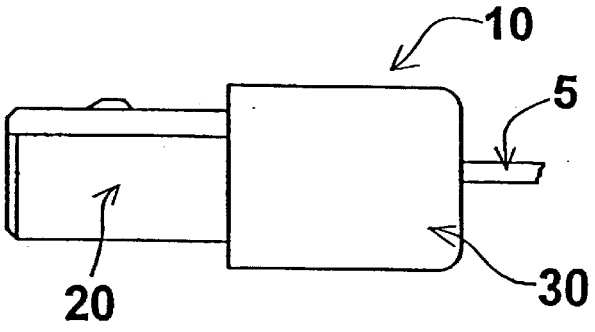
FIG. 4 is a side view of the electrical connector of FIG. 1.

FIGS. 1–4 show an embodiment of the electrical connector according to the present invention with a flexible circuit board connected to it at one side. FIG. 1 also depicts a portion of a carrier strip. The electrical connector 10 is designed for joining a flexible circuit board at one side and a mating connector (not shown in the drawing) at the opposite side and consists of an insulating housing 20, an auxiliary housing 30 and multiple contacts 50 retained in the insulating housing 20. Contacts 50 are fabricated from a metal sheet material by punch cutting process and are secured in vertical cavities 21 provided in the insulating housing 20. The auxiliary housing 30, as explained in more detail below, is provided to facilitate the joining of the flexible circuit board 5 with the contacts 50, and the flexible circuit board 5 extends from the long and narrow opening 31 provided in the auxiliary housing 30.

Figure 5:
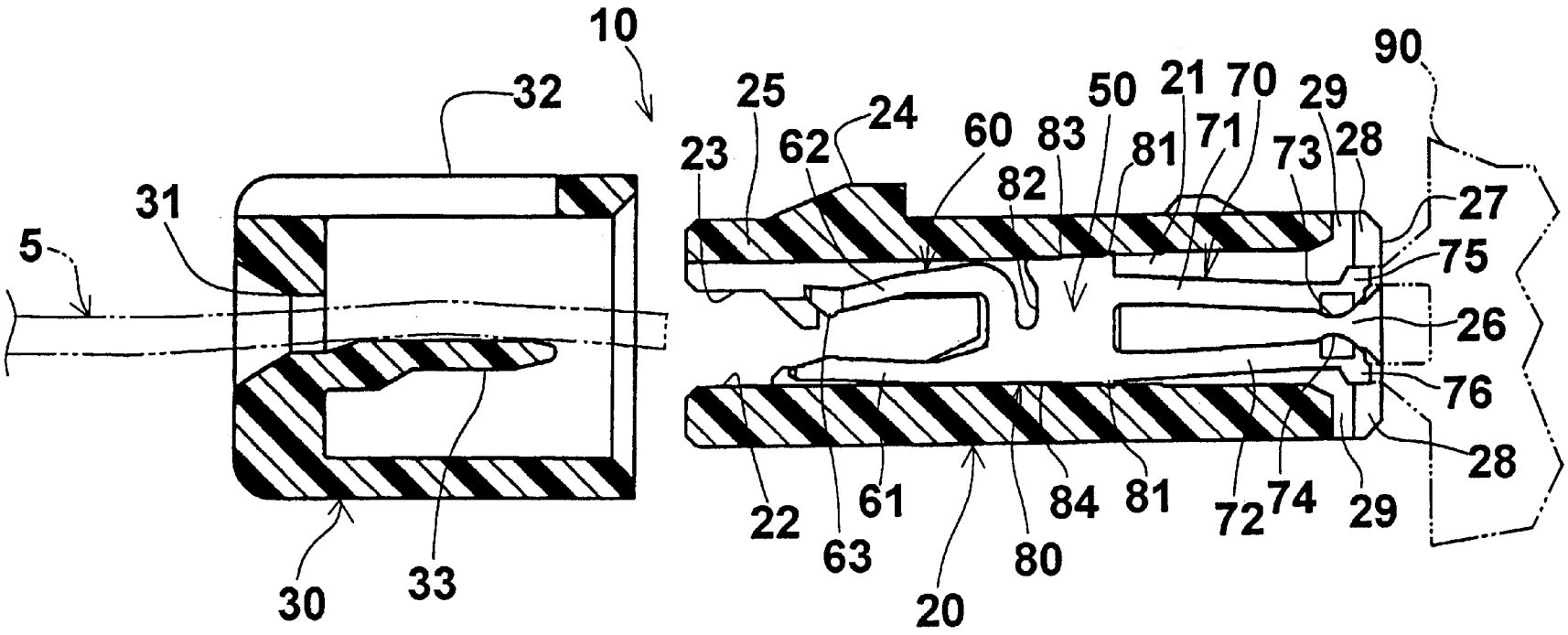
FIG. 5 is an exploded cross section along taken line A—A of the electrical connector shown in FIG. 1 with a portion of the carrier strip shown by dotted lines.

As shown in FIG. 5, contacts 50 consist of primary and secondary female type contacting sections 60 and 70 that extend in opposite directions and a base section 80 located between said contacting sections. The base section 80 is wider than the female contacting sections 60 and 70 and intersects the cavity 21 in the vertical direction. Press-in lugs 81 are provided at both edges 83 and 84 of base section 80. Therefore, when the contact 50 is inserted in the cavity 21, the base section 80 of the contact 50 is pressed-in the inner sides of the cavity 21.

The primary female-type contacting section 60 is intended for the connection to signal circuits of the flexible circuit board 5. It has a first arm 61 of a relatively low resilience that extends along the bottom surface 22 of the cavity 21 and a second arm 62 that is arch shaped with the apex facing up. Between the second arm 62 and the base section 80, a groove 82 is formed, while the first arm 61 is connected directly to the base section 80. Therefore, the engagement dimension at the lower edge 84 is slightly longer than at the upper edge 83.

A connection slot 23 formed in the insulating housing 20 that extends horizontally, intersecting the cavity 21, is intended for engagement between the flexible circuit board 5 and pressure lug 33 formed in the auxiliary housing 30. The purpose of the cavity 21 is to establish a proper pressure by the contacting lug 63 of the second arm 62 on the signal circuits formed on the upper surface of the flexible circuit board 5 when the flexible circuit board and the pressure lug 33 are inserted between the arms 61 and 62.

Referring back to FIG. 1, the auxiliary housing has a latching device 32 arranged on one side of said housing which engages with a locking lug 24 made on the insulating housing 20, thus securing the auxiliary housing on the insulating housing 20. The locking lug 24 is located on the outer surface of the upper side wall relatively close to the second arm 62 of the female type contacting section 60 that is used to form contact with the flexible circuit board 5.

Referring back to FIG. 5, the second female type contacting section 70 intended for the connection to a matching male-type connector (not shown in the drawing) has two arms 71 and 72 that form contact with the upper and lower surfaces of the mating contact. The two arms 71, 72 have a symmetrical configuration and extend almost along straight lines from the base section 80. However, the symmetry axis of the arms 71, 72 is slightly shifted toward the bottom of the base section 80.

Figure 6:
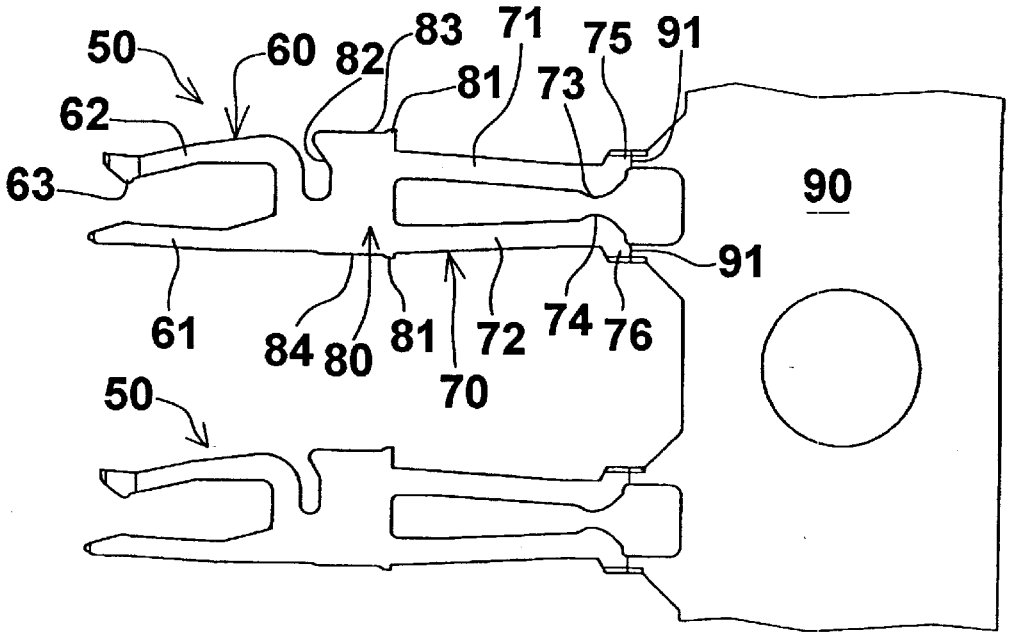
FIG. 6 is a plan view of the contacts used in the electrical connector shown in FIG. 1 together with the carrier strip.

In the insulating housing 20, a plug accepting slot 26 is formed for a mating connector that is joined with the second female-type contacting section 70. The two arms 71, 72 have contacting lugs 73, 74 that are located at the opposite sides of the slot 26 and protrusions 75, 76 extend outward from said contacting lugs 73, 74. As can be seen from FIGS. 5 and 6, carrier strip 90 is connected to secondary female type contacting section 70 at the connector assembly stage for the insertion into the insulating housing 20.

In the state when the contacts are connected to the carrier strip 90, at the boundary of the strip, notches 91 are formed. The contacts 50 are inserted into the insulating housing 20 in the state when they are an integral part of the carrier strip 90, and after they are pressed in to a predetermined position and secured in the housing, the strip is twisted as shown in FIG. 1 by dotted lines (in the direction of arrow T) until it is separated from the contacts at the notches 91. In order to make this twisting operation possible, at the mating face 27 of the insulating housing 20, all cavities 21 have chamfered edges 28. Another purpose of these chamfered edges 28 is to guide male-type contacts of the mating connectors in the process of their connection.

In addition, it should be noted that in all cavities 21 near the mating face of the insulating housing 20, through openings 29 are provided. The purpose of these through openings 29 is to inspect the separation of the carrier strip 90 during that operation and to provide space for the deflection of arms 71, 72.

Figure 7:
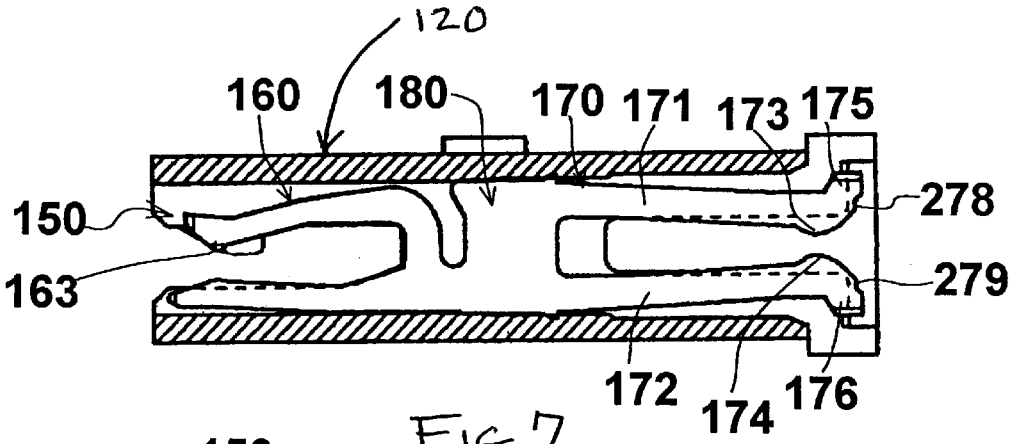
FIG. 7 is a cross-sectional view taken through the contact position of another embodiment of the electrical connector according to this invention.
Figure 8:
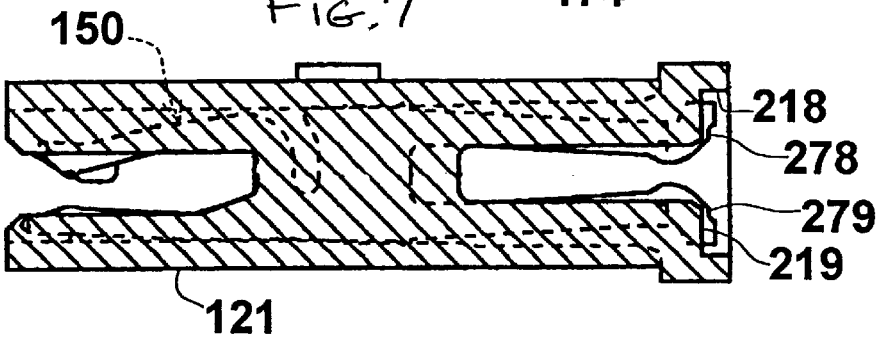
FIG. 8 is a cross-sectional view of the electrical connector of FIG. 7 taken through a position near the contact cavity.

In FIGS. 7 and 8, an alternative embodiment electrical connector 100 is shown. Since its basic configuration is similar to that of the preferred embodiment, the identical components are numbered by adding 100 to the numbers of components of the previous embodiment and explanations pertaining thereto are omitted. (Components that are unique to this embodiment have their numbers increased by 200). Differences between the electrical connector 10 and the electrical connector 100 are that due to a lower profile of the electrical connector 100, the axis of symmetry of the secondary female-type contacting section 170 coincides with the axis of the base section 180. Also, the means determining the depth of the pressing-in of contacts 150 in the electrical connector 100 are provided in the insulating housing 120, as follows.

At the tips of the contacting lugs 173, 174 of the two arms 171, 172 of the secondary female-type contacting section 170, vertical edge pieces 278, 279 extending in the vertical direction are provided. (It is possible to use a similar configuration in contacts 50 as well). When the contacts 150 are pressed in, these vertical edge pieces 278, 279 are used as the application points for a pressing tool. In addition, in the insulating housing 120, a rectangular recess 218 is provided that is separate from the cavity 121. The bottom part 219 of the rectangular recess 218 can be used as a stop for the press-in tool. Namely, when the contact 150 is inserted in the cavity 121 by means of the press-in tool (not shown in the drawing), the movement of the press-in tool is stopped by the bottom part 219 once the contact 150 reaches the predetermined position, thus ensuring the insertion of the contact 150 to the precise position.

Based on the foregoing description, it is evident that the electrical connector of the present invention offers a relatively small configuration enabling mutual connection of devices arranged at opposite sides of the connector.

It is apparent that various changes may be made in the form, construction, and arrangement of parts thereof without departing from the spirit of the invention, or sacrificing all of its material advantages. Thus, while embodiments of the invention have been disclosed, it is to be understood that the invention is not strictly limited to such embodiments but may be otherwise variously embodied and practiced within the scope of the appended claims.

We claim:

1. An electrical connector comprising:

a housing having contact receiving cavities;

contacts mounted in the housing which have primary and secondary female contacting sections extending in one plane in mutually opposite directions;

a base section located on the contacts at a midpoint between the primary and secondary female contacting sections, the base section being press fitted in the contact receiving cavities;

the housing having a mating face with chamferred edges provided at the ends of the contact receiving cavities;

whereby as the contacts are inserted into the contact receiving cavities, the contacts are connected to a carrier strip to facilitate the insertion, and after the contacts are properly mounted in the housing, the chamferred edges allow the carrier strip to be moved from side to side relative to the axis of each respective contact, thereby allowing the carrier strip to be removed from the contacts.

2. The electrical connector of claim 1, wherein the primary and secondary female contacting sections each have opposing contact arms.

3. The electrical connector of claim 1, wherein protrusions are provided on the base section.

4. The electrical connector of claim 1, wherein the opposing contact arms of the secondary female contacting section are symmetrical.

5. The electrical connector of claim 2, wherein one of the opposing contact arms of the primary female contacting section is separated from the base section by a groove.

6. The electrical connector of claim 1, wherein an auxiliary housing is provided having an opening to receive a flexible printed circuit therethrough, the auxiliary housing being mateable with the electrical connector housing thereby terminating the flexible printed circuit to the primary female contacting section.

7. An electrical connector as recited in claim 1 wherein the carrier strip is connected to the secondary female contacting sections as the contacts are inserted into the contact receiving cavities.

8. An electrical connector as recited in claim 7 wherein through openings extend between contact receiving sections proximate the mating face, whereby the through openings allow the inspection of the separation of the carrier strip from the contact and facilitate deflection of secondary female contact sections.

9. An electrical connector as recited in claim 8 wherein vertical edge pieces are provided at ends of the female contacting sections, the vertical edge pieces cooperate with a pressing tool which facilitates the insertion of the contacts into the contact receiving cavities.

10. An electrical connector for connecting a flexible printed circuit component to a second circuit component, the electrical connector comprising:

a housing having a plurality of contact receiving cavities and a mating face with chamferred edges provided at the ends of the contact receiving cavities;

planar electrical contacts having female receptacle sections extending in opposite directions from a base section, the electrical contacts being secured in the housing by press fit engagement of the base section with the housing;

whereby as the contacts are inserted into the contact receiving cavities, the contacts are connected to a carrier strip to facilitate the insertion into the contact receiving cavities, and after the contacts are properly mounted in the housing, the chamferred edges allow the carrier strip to be moved from side to side relative to the axis of each respective contact, thereby allowing the carrier strip to be removed from the contacts.

11. The electrical connector of claim 10, wherein the female receptacle sections each have opposing contact arms which extend from the base section to free ends.

12. The electrical connector of claim 11, wherein one of the opposing contact arms is separated from the base section by a groove.

13. The electrical connector of claim 10, wherein the base section has side edges with protrusions for engagement with the housing.

14. The electrical connector of claim 10, further comprising an auxiliary housing having an opening for receiving the flexible printed circuit therethrough, the auxiliary housing being mateable with the electrical connector housing thereby terminating the flexible printed circuit to one of the receptacle contact sections.

* * * * *